US006648734B2

(12) United States Patent
Chin et al.

(10) Patent No.: US 6,648,734 B2
(45) Date of Patent: Nov. 18, 2003

(54) POLISHING HEAD FOR PRESSURIZED DELIVERY OF SLURRY

(75) Inventors: Fook Loong Chin, Orlando, FL (US); Arun Nanda, Orlando, FL (US); Frank Miceli, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 2 days.

(21) Appl. No.: 09/943,630

(22) Filed: Aug. 30, 2001

(65) Prior Publication Data

US 2003/0045220 A1 Mar. 6, 2003

(51) Int. Cl.[7] ..... B24B 1/00
(52) U.S. Cl. ..... 451/41; 451/60; 451/287
(58) Field of Search ..... 451/285–289, 451/41, 60, 397, 398, 402

(56) References Cited

U.S. PATENT DOCUMENTS 5,944,593 A * 8/1999 Chiu et al. ..... 451/442
6,183,350 B1 * 2/2001 Lin et al. ..... 451/41
6,241,582 B1 * 6/2001 Lin et al. ..... 451/41
6,293,850 B1 * 9/2001 Lin et al. ..... 451/41

FOREIGN PATENT DOCUMENTS

EP 1 038 636 * 9/2000 ..... B24B/37/04

* cited by examiner

*Primary Examiner*—M. Rachuba

(57) ABSTRACT

The present invention provides a polishing head, for use with a polishing apparatus. In one embodiment, the polishing head includes a carrier head assembly, and a retaining ring having a surface positionable adjacent a polishing pad and couplable to the carrier head assembly and configured to retain a semiconductor wafer therein, the retaining ring having a slurry conduit located therethrough to provide a flow of slurry to the polishing pad.

20 Claims, 3 Drawing Sheets

POLISHING HEAD FOR PRESSURIZED DELIVERY OF SLURRY

TECHNICAL FIELD OF THE INVENTION

The present invention is directed, in general, to the polishing of semiconductor wafers and, more specifically, to a polishing head for delivering slurry, a polishing system employing the polishing head and a method manufacturing an integrated circuit incorporating the polishing head or the polishing system.

BACKGROUND OF THE INVENTION

In the fabrication of semiconductor components, the various devices are formed in layers upon an underlying substrate, such as silicon. In such semiconductor components, it is desirable that all layers, including insulating layers, have a smooth surface topography, since it is difficult to lithographically image and pattern layers applied to rough surfaces. Conventional chemical/mechanical polishing (CMP) has been developed for providing smooth semiconductor topographies. Typically, a given semiconductor wafer may be polished several times, such as upon completion of each metal layer.

The CMP process involves holding, and optionally rotating, a thin, reasonably flat, semiconductor wafer, held in a carrier head having a retainer ring, against a rotating polishing pad. The wafer may be repositioned radially within a set range as the polishing pad is rotated across the surface of the wafer. The polishing surface, which conventionally includes a polyurethane material affixed to a platen, is wetted by a chemical slurry, under controlled chemical, solid contents, pressure, and temperature conditions. The chemical slurry contains selected chemicals that etch or oxidize selected surfaces of the wafer during the CMP process in preparation for their removal.

Additionally, the slurry contains a polishing agent, such as alumina or silica, that is used as the abrasive material for the mechanical removal of the semiconductor material. The combination of chemical and mechanical removal of material during the polishing process results in superior planarization of the polished surface of the semiconductor wafer. In this process it is important to remove a sufficient amount of material to provide a smooth surface, without removing an excessive amount of underlying materials. To this end, proper slurry distribution during the polishing process is imperative. Accurate material removal is particularly important in today's submicron technologies where the layers between device and metal levels are constantly getting thinner.

In addition to proper slurry distribution during planarizing, some CMP systems are also directed to controlling the profile of polishing pads so as to control the "edge effect" of wafers being polished. Edge effect includes the non-uniform material removal from the edge, versus the center, of semiconductor wafers caused by a flexing in the CMP polishing pad near the wafer edge. As edge effect becomes more predominant, edge exclusion, which is the inability to print and fabricate dies along the edge of the wafer, typically increases. To combat this edge effect, conventional CMP systems attempt to press the retainer ring surrounding the wafer down into the polishing pad. By pressing the retainer ring into the polishing pad, pad deformation occurs under the retainer ring rather than under the edge of the wafer. As a result, edge effect of a semiconductor wafer may be significantly reduced or even eliminated.

Unfortunately, although substantially addressing the problem of edge effect, the prior art techniques introduce other problems. Specifically, to press the retainer ring down into the polishing pad, complex and costly pneumatic or hydraulic systems must be constructed to properly maneuver the retainer ring without damaging the wafer or the polishing pad. In addition, pressing the retainer ring against an abrasive polishing pad eventually wears the ring to the point of needing replacement. Moreover, since the retainer ring surrounds the outer edge of the wafer, pressing the ring into the polishing pad may significantly prevent the distribution of slurry to the wafer surface.

Accordingly, what is needed in the art is a apparatus and method for delivering slurry during a polishing operation that does not suffer from the deficiencies found in the prior art.

SUMMARY OF THE INVENTION

To address the above-discussed deficiencies of the prior art, the present invention provides a polishing head, for use with a polishing apparatus. In one embodiment, the polishing head includes a carrier head assembly, and a retaining ring having a surface positionable adjacent a polishing pad and couplable to the carrier head assembly and configured to retain a semiconductor wafer therein, the retaining ring having a slurry conduit located therethrough to provide a flow of slurry to the polishing pad.

In another aspect, the present invention provides a polishing system. In one embodiment, the polishing system includes a retaining ring having a surface positionable adjacent a polishing pad and couplable to a carrier head assembly and configured to retain a semiconductor wafer therein, the retaining ring having a slurry conduit formed therein to provide a flow of slurry to the polishing pad. In addition, the polishing system includes a pump configured to deliver the flow of slurry under pressure through the slurry conduit to a surface of the polishing pad.

In yet another aspect, the present invention provides a method of manufacturing an integrated circuit. In an exemplary embodiment, the method includes forming an integrated circuit layer over a semiconductor wafer, and polishing the integrated circuit layer. During the polishing, the method includes flowing a pressurized slurry through a slurry conduit located within a retaining ring of a carrier head assembly and against a surface of a polishing pad, the pressurized slurry causing a surface of the polishing pad located under the retaining ring to deform in a direction away from said retaining ring.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following detailed description taken in conjunction with the accompanying FIGUREs. It is emphasized that various features may not be drawn to scale. In fact, the dimensions of various features may be arbitrarily increased or reduced for clarity of discussion. Reference is now made to the following descriptions taken in conjunction with the accompanying drawings, in which.

DETAILED DESCRIPTION

Figure 1:
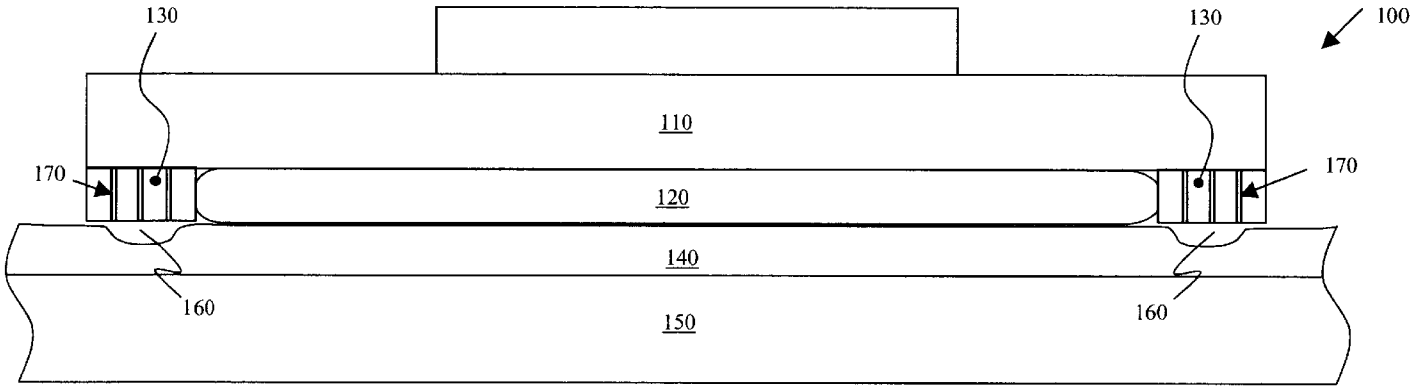
FIG. 1 illustrates a sectional view of one embodiment of a polishing apparatus manufactured according to the principles of the present invention.

Referring initially to FIG. 1, illustrated is a sectional view of one embodiment of a polishing head 100 manufactured according to the principles of the present invention. As shown, the polishing head 100 includes a carrier head assembly 110. A semiconductor wafer 120 is positioned against a face of the carrier head assembly 110, and may be secured to the carrier head assembly 110 using negative pressure (vacuum), adhesive or other conventional technique.

Coupled to the carrier head assembly 110 is a retaining ring 130 manufactured according to the principles of the present invention. The retaining ring 130 may be formed integrally with the carrier head assembly 110, and is in part used to retain the wafer 120 therein during a polishing operation. Alternatively, the retaining ring 130 may be removably couplable to the carrier head assembly 110. Having an annular shape, the retaining ring 130 is configured to retain the semiconductor wafer 120 within an inside diameter of the retaining ring 130. By retaining it therein, the retaining ring 130 prevents the wafer 120 from excessive movement during a polishing operation. Those skilled in the art understand the importance of securely holding the wafer 120 during polishing so as to prevent any damage thereto. Located within the retaining ring 130 are slurry conduits 170, manufactured in accordance with the principles of the present invention.

During a polishing operation, such as a CMP process, the carrier head assembly 110 presses the wafer 120 against an abrasive surface of a polishing pad 140, typically formed from polyurethane. The CMP process may be employed to polish, for instance, an integrated circuit layer of the wafer 120. As used herein, the term "integrated circuit layer" includes any layer of a semiconductor wafer forming a part of an integrated circuit. Those skilled in the art will understand the principles of the present invention described herein may be used to polish any type of integrated circuit layer.

The polishing pad 140 is mounted on a polishing platen 150, which is rotated during the polishing operation. In addition, the carrier head assembly 110 may also be rotated during the polishing operation if desired. As the carrier head assembly 110 presses the wafer 120 against the polishing pad 140, a slurry delivery system (not illustrated) forces a flow of slurry through slurry conduits 170 formed in the retaining ring 130. In an advantageous embodiment, the carrier head assembly 110 includes a carrier head slurry conduit (not illustrated) couplable to the slurry conduits 170 of the retaining ring 130. In such an embodiment, the slurry flows through the carrier head slurry conduit to the slurry conduits 170 in the retaining ring 130.

By pressurizing the slurry and forcing it through the slurry conduits 170 with a slurry pump, the polishing head of the present invention causes pad deformations 160 to occur directly beneath the retaining ring 130. By deforming the polishing pad 140 under the retaining ring 130 rather than under the edge of the wafer 120, the present invention substantially prevents the problem of edge effect on the wafer 120. Moreover, by creating the pad deformations 160 with the pressurized flow of slurry, the surface of the retaining ring 130 positionable adjacent the polishing pad 140 is prevented from physically contacting the polishing pad 140 during the polishing operation. Those skilled in the art understand the benefits of preventing such contact, as discussed in greater detail below.

Figure 2:
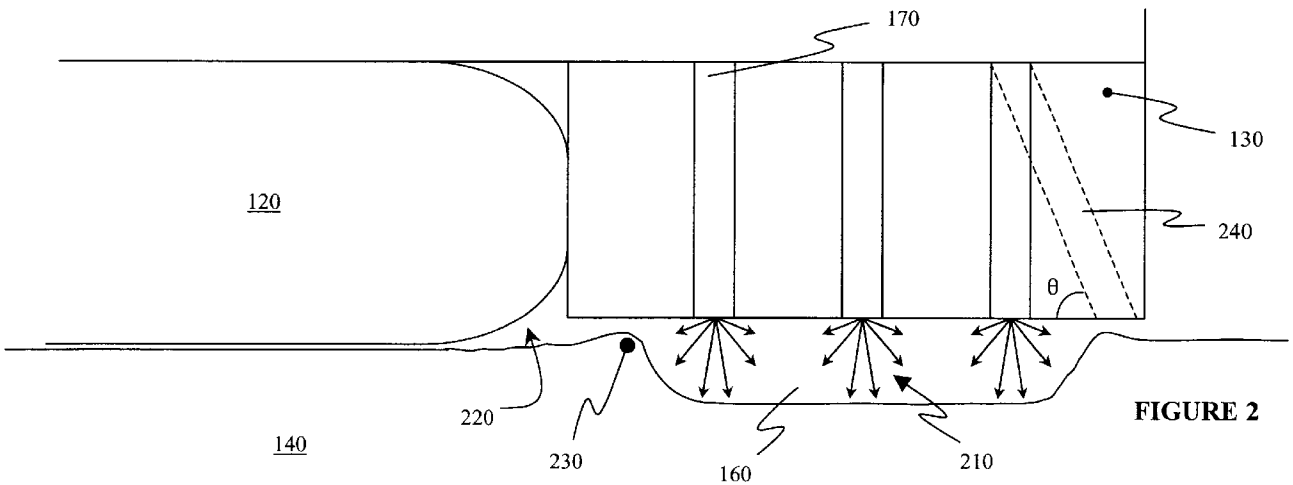
FIG. 2 illustrates a close-up, sectional view of the retaining ring shown in FIG. 1.

Turning now to FIG. 2, illustrated is a close-up, sectional view of the retaining ring 130 shown in FIG. 1. Also illustrated are the semiconductor wafer 120 and the polishing pad 140 discussed above. Now shown in detail are the slurry conduits 170 for passing a flow of slurry (one flow is designated 210) through. As the flow of slurry 210 is forced through the slurry conduits 170, the pressure of the slurry 210 exiting the bottom face of the retaining ring 130 creates the pad deformation 160 described above.

In accordance with principles discussed herein, by creating the pad deformation 160 under the retaining ring 130 rather than under the wafer 120, a polishing head of the present invention substantially prevents detrimental edge effect at an edge 220 of the wafer 120. More specifically, when the flow of slurry 210 creates the pad deformation 160, corners (one of which is designated 230) of the polishing pad 140 are formed around the indention. Such a corner 230 would likely be the cause of edge effect on the wafer 120 if the pad deformation were formed under the wafer edge 220 rather than the retaining ring 130. As such, in a preferred embodiment, the slurry conduits 170 are located within the retaining ring 130 a sufficient distance from the wafer 120 so as not to inadvertently cause an edge effect under the edge 220 of the wafer 120.

In addition, a pressure of the flow of slurry 210 delivered by a slurry pump (not illustrated) may be selected such that although pad corners 230 are still formed, the polishing pad 140 is kept away a sufficient distance so as not to contact the retaining ring 130. As mentioned above, by preventing the retaining ring 130 from contacting the polishing pad 140, a less complex polishing head is provided and the life of the retaining ring 130, as well as the polishing pad 140, may be significantly extended. Moreover, by preventing contact between the retaining ring 130 and the polishing pad 140, excess vibration in the carrier head assembly 110 may also be reduced. In an advantageous embodiment, the pressure provided by the slurry pump ranges from about 7 psi to about 30 psi. Of course, other pressures may be used, perhaps based on the desired distance the polishing pad 140 is to be kept away from the retaining ring 130. For example, specific mechanical properties of the material comprising the polishing pad 140 may affect the slurry delivery pressure needed to achieve the desired pad deflection. In addition, characteristics of the slurry itself, such as viscosity and tendency to agglomerate, may also affect the delivery pressure to be applied.

In another embodiment, the flow rate at which the flow of slurry 210 is expelled through the slurry conduits 220 ranges from about 200 ml/minute to about 700 ml/minute. Those skilled in the art understand that other flow rates may be employed, perhaps depending on the amount of polishing desired, without departing from the broad scope of the present invention. In addition, the type of slurry used during the polishing operation may affect the flow rate of slurry 210. Of course, a polishing head manufactured according to the principles discussed herein may accommodate any type of slurry, and may be employed in any type of polishing operation.

Another advantage provided by the present invention is a better flow of slurry to the wafer 120. In typical prior art slurry delivery systems, when the retaining ring 130 is pressed against the polishing pad 140 during a polishing operation, the contact between the retaining ring 130 and the polishing pad 140 may significantly prevent the flow of slurry 210 to the wafer 120. Those skilled in the art understand that an adequate amount of slurry 210 at the interface between the polishing pad 140 and the wafer 120 is essential for accurate planarization. The polishing head of the present invention recognizes and addresses this problem. For instance, by preventing the polishing pad 140 from contacting the retaining ring 130, a space between the two remains that allows slurry 210 to pass from outside the retaining ring 130 to the wafer 120 held on the inside where the slurry 210 is needed the most.

Furthermore, prior art slurry delivery systems apply slurry to a polishing pad at the center of the pad, or at least typically at a point distal from a wafer being polished. In contrast, the polishing head of the present invention applies the slurry 210 to the polishing pad 140 through the retaining ring 130, immediately adjacent the edge 220 of the wafer 120. By delivering the slurry 210 so close to the wafer 120, a polishing head constructed according to the present invention again assures the slurry 210 is delivered where it is needed the most. Moreover, with the slurry 210 now being delivered where it is more likely needed, the present invention allows for a more efficient amount of slurry 210 to be used during the polishing operation. Of course, the present invention may include embodiments where the delivery system described herein is combined with such prior art systems, to further ensure the proper delivery of slurry throughout a polishing operation. Yet another advantage provided by the present invention is an improved rate of moistening the polishing pad 140 prior to polishing the wafer 120. It is common practice to thoroughly wet a polishing pad before polishing a wafer so as to insure a more uniform planarization of a wafer. With the pressurized slurry delivery of the polishing head discussed herein, wetting of the polishing pad 140 may occur in an shorter amount of time, rendering the polishing operation more efficient.

In one embodiment, the slurry conduits 170 may be formed in the retaining ring 130 so as to make an angle normal (perpendicular) with the surface of the retaining ring 130 positionable adjacent the polishing pad 140. Such a configuration would provide a vertically downward pressure on the polishing pad 140 by the pressurized flow of slurry 210 exiting the slurry conduits 170. In an alternative embodiment, where the retainer ring 130 includes multiple slurry conduits 170 at varying distances from the edge 220 of the wafer 120, an outer conduit 240 (illustrated in broken line in FIG. 2) may make an abnormal angle θ with this surface of the retaining ring 130. In such an embodiment, the outer conduit 240 may carry pressurized water or other cleaning solution, rather than slurry 210. Having the abnormal angle θ, the cleaning solution in such an embodiment may be sprayed at the polishing surface of the polishing pad 140 so as to clear debris, polishing residue or other particles from in front of the retaining ring 130 as it moves across the polishing pad 140 during a polishing operation. As a result, more accurate planarization of the wafer 120 may be accomplished by removing harmful particles before they can detrimentally impact the polishing process.

Figure 3:
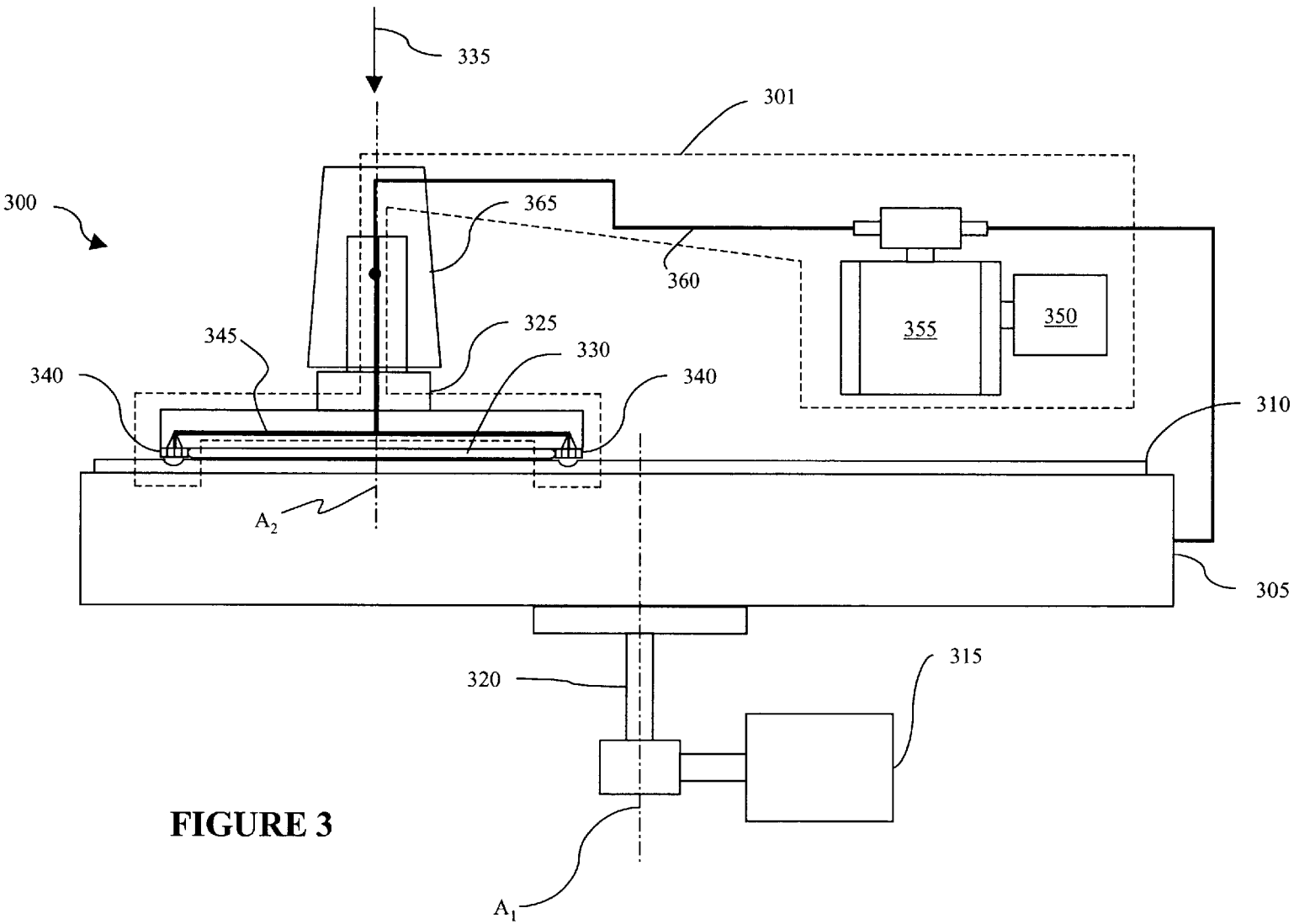
FIG. 3 illustrates a CMP system for planarizing a semiconductor wafer which may provide an environment for a polishing apparatus manufactured according to the principles of the present invention.

Looking now at FIG. 3, illustrated is a polishing system 300 which may provide an environment for a slurry delivery system 301 incorporating a polishing head manufactured according to the principles of the present invention. The polishing system 300 includes a polishing pad 310 for polishing a semiconductor substrate 330 and a polishing platen 305 on which the polishing pad 310 is securely mounted. The polishing system 300 further includes a drive motor 315 coupled to a drive shaft 320. The drive shaft 320, in turn, is coupled to the polishing platen 305. During a polishing operation, the drive motor 315 is used to turn the drive shaft 320, thereby rotating the polishing platen 305 and polishing pad 310 about a first axis $A_1$.

The polishing system 300 still further includes a carrier head assembly 325. Mounted to the carrier head assembly 325 is the substrate 330, which may be a semiconductor wafer, that has been selected for polishing. During the polishing process, a downward force 335 is applied to the carrier head assembly 325, causing the carrier head assembly 325 to press the substrate 330 against the polishing pad 310, as the polishing pad 310 is rotated. Typically, the carrier head assembly 325 may also be rotated using another motor during the polishing operation about a second axis $A_2$.

In accordance with the principles described herein, a retaining ring 340 surrounding the substrate 330 and mounted to the carrier head assembly 325 is not pressed into the polishing pad 310. Instead, the slurry delivery system 301 is used to cause deformations in the polishing pad 310 underneath the retaining ring 340, rather than underneath the substrate 330, in order to prevent edge effect. The slurry delivery system 301 includes a slurry pump 350 having a supply tank 355. As illustrated, the slurry pump 350 may be located near the polishing pad 310 and used to pressurize slurry held in the supply tank 355. In addition, the slurry delivery system 301 includes a slurry delivery conduit 360, coupled to carrier head slurry conduits 345 formed within the carrier head assembly 325. The carrier head slurry conduits 345 are coupled to slurry conduits (not separately designated) in the retaining ring 340 to provide a flow of slurry therethrough.

In accordance with the present invention, slurry is delivered from a slurry pump 350 to the carrier head slurry conduits 345, passing through a mandrel 365 holding the carrier head assembly 325. The slurry then passes from the carrier head slurry conduits 345 to the slurry conduits in the retaining ring 340. The slurry pump 350 pressurizes the flow of slurry such that the slurry is expelled from a surface of the retaining ring 340 adjacent the polishing pad 310 with enough force to deform portions of the polishing pad 310 located under the retaining ring 340 away from the retaining ring 340. In this manner, edge effect on the substrate 330 may be substantially prevented without contacting the retaining ring 340 against the abrasive polishing pad 310. Of course, those skilled in the art understand a polishing system 300 constructed according to the principles of the present invention may include a greater or lesser number of components, or perhaps variations of the components illustrated in FIG. 3, while remaining within the scope of the present invention.

By providing a slurry delivery system, and a polishing apparatus incorporating such a system, that produces a pressurize flow of slurry from a retaining ring surrounding a wafer to substantially prevent edge effect of a wafer, the present invention provides several benefits over the prior art. For instance, as discussed above, the present invention may provide a better flow of slurry to the interface between a polishing pad and the wafer than previously found in the art. Those skilled in the art understand that slurry is needed most at the interface between the two. Moreover, since a system according to the present invention applies slurry immediately adjacent the edge of the wafer, less slurry may be used during a polishing operation. Also, the life of a retaining ring, as well as a polishing pad, may be significantly extended by preventing the retaining ring from contacting the polishing pad, since the flow slurry prevents direct frictional contact between the two. Moreover, a delivery system according to the present invention may be employed in almost any apparatus used to polish substrates, while retaining benefits such as those described above. As discussed above, those skilled in the art understand the risk of edge exclusion of dies, as well as other defects, that may occur if edge effect on a semiconductor wafer is not reduced or eliminated.

Figure 4:
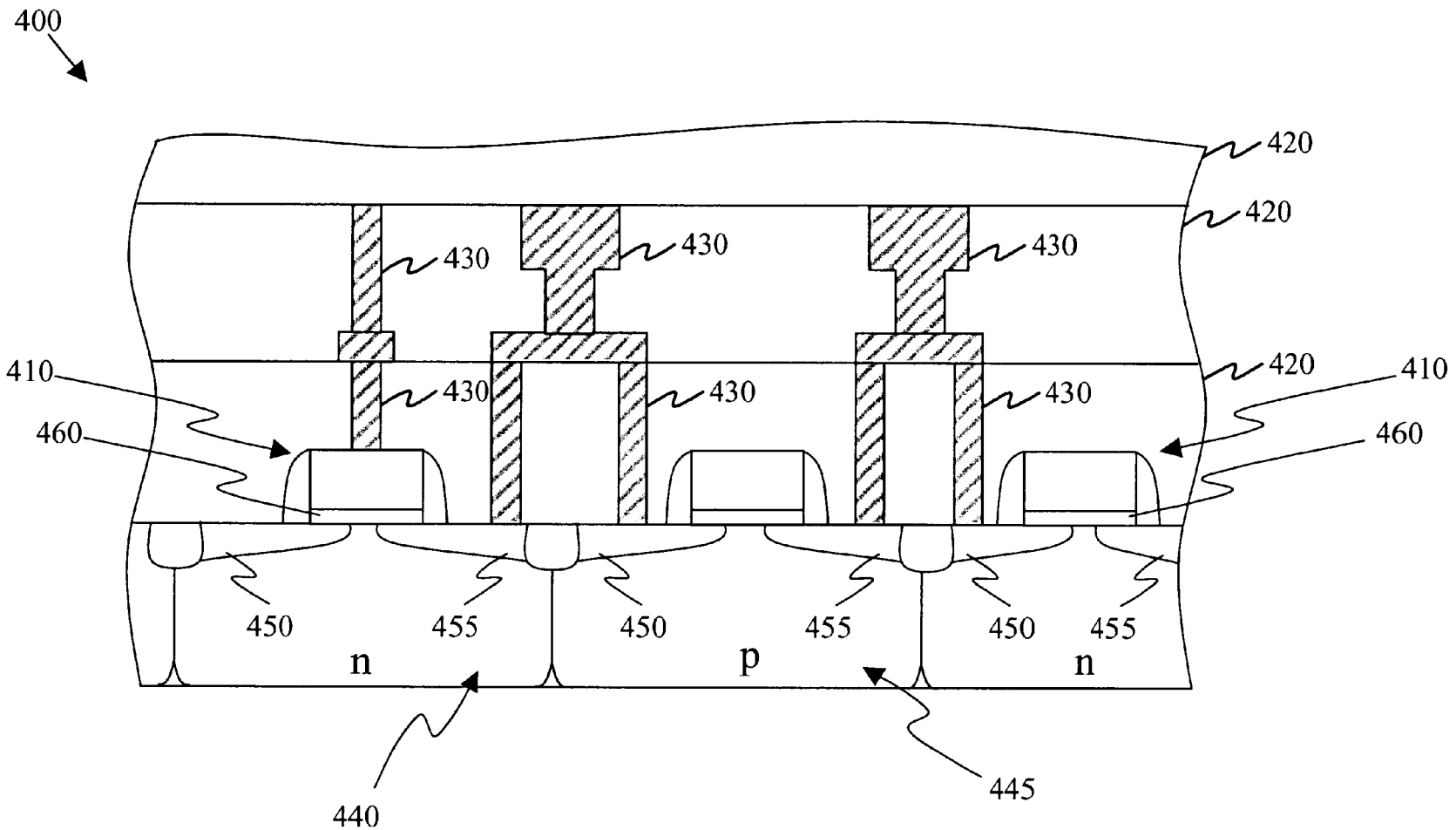
FIG. 4 illustrates a sectional view of a conventional integrated circuit (IC), which may be formed using the polishing system of the present invention.

Turning finally to FIG. 4, illustrated is a sectional view of a conventional integrated circuit (IC) 400, which may be formed using the polishing system of the present invention. The IC 400 may include active devices, such as transistors, used to form CMOS devices, BiCMOS devices, Bipolar devices, or other types of active devices. The IC 400 may further include passive devices such as inductors or resistors, or it may also include optical devices or optoelectronic devices. Those skilled in the art are familiar with these various types of device and their manufacture.

In the embodiment illustrated in FIG. 4, components of the conventional IC 400 include transistors 410, having gate oxide layers 460, formed on a semiconductor wafer. The transistors 410 may be metal-oxide semiconductor field effect transistors 410 (MOSFETs), however other types of transistors are within the scope of the present invention. Interlevel dielectric layers 420 are then shown deposited over the transistors 410.

The polishing system of the present invention may be used to polish any or all of the layers of the IC 400, including the interlevel dielectric layers 420, in accordance with the principles described above. Interconnect structures 430 are formed in the interlevel dielectric layers 420 to form interconnections between the various components therein to form an operative integrated circuit. In addition, the interconnect structures 430 also connect the transistors 410 to other areas or components of the IC 400. Those skilled in the art understand how to connect these various devices together to form an operative integrated circuit. Also illustrated are conventionally formed tubs 440, 445, source regions 450, and drain regions 455.

Of course, use of the polishing system of the present invention is not limited to the manufacture of the particular IC 400 illustrated in FIG. 4. In fact, the present invention is broad enough to encompass the manufacture of any type of integrated circuit formed on a semiconductor wafer which would benefit from polishing performed in accordance with the present invention. In addition, the present invention is broad enough to encompass integrated circuits having greater or fewer components than illustrated in the IC 400 of FIG. 4. Beneficially, each time the present invention is employed to form part or all of the IC 400, manufacturing costs may be eliminated from the entire manufacturing process, as discussed in detail above.

Although the present invention has been described in detail, those skilled in the art should understand that they can make various changes, substitutions and alterations herein without departing from the spirit and scope of the invention in its broadest form.

What is claimed is:

1. A method of manufacturing an integrated circuit, comprising:

forming an integrated circuit layer over a semiconductor wafer; and polishing the integrated circuit layer, including:

flowing a pressurized slurry through a slurry conduit located within a retaining ring of a carrier head assembly and against a surface of a polishing pad, wherein all portions of the slurry conduit located within the retaining ring make an angle normal with the surface of the retaining ring positionable adjacent the polishing pad, the pressurized slurry causing a surface of the polishing pad located under the retaining ring to deform in a direction away from the retaining ring.

2. The method as recited in claim 1 wherein the flowing occurs at a flow rate ranging from about 200 ml/minute to about 700 ml/minute.

3. The method as recited in claim 1 wherein the flowing includes flowing a pressurized slurry through a slurry conduit using a slurry pump.

4. The method as recited in claim 3 wherein a pressure of the slurry pump ranges from about 7 psi to about 35 psi.

5. The method as recited in claim 1 wherein the flowing includes flowing a pressurized slurry through a carrier head slurry conduit and through a plurality of slurry conduits located within the retaining ring.

6. The method as recited in claim 5 wherein the flowing includes flowing a pressurized slurry to the carrier head slurry conduit from a slurry delivery system having a supply tank and a delivery conduit coupled to the supply tank.

7. For use with a polishing apparatus, a polishing head, comprising:

a carrier head assembly; and a retaining ring having a surface positionable adjacent a polishing pad and couplable to the carrier head assembly and configured to retain a semiconductor wafer therein, the retaining ring having a slurry conduit located therethrough to provide a flow of slurry to the polishing pad, wherein all portions of the slurry conduit located within the retaining ring make an angle normal with the surface of the retaining ring positionable adjacent the polishing pad.

8. The polishing head as recited in claim 7 wherein the retaining ring is integrally formed with the carrier head assembly.

9. The polishing head as recited in claim 7 wherein the retaining ring is removably couplable to the carrier head assembly.

10. The polishing head as recited in claim 7 wherein the retainer ring includes a plurality of slurry conduits located within the retaining ring.

11. The polishing head as recited in claim 10 wherein at least one of the slurry conduits is positioned at an angle abnormal with respect to the surface.

12. The polishing head as recited in claim 10 wherein the carrier head assembly includes a carrier head slurry conduit that provides a flow of pressurized slurry through each of the plurality of slurry conduits in the retaining ring.

13. The polishing head as recited in claim 7 wherein the carrier head assembly includes a carrier head slurry conduit that is fluidly couplable to the slurry conduit.

14. A polishing system, comprising:

a retaining ring having a surface positionable adjacent a polishing pad and couplable to a carrier head assembly and configured to retain a semiconductor wafer therein, the retaining ring having a slurry conduit formed therein to provide a flow of slurry to the polishing pad; wherein all portions of the slurry conduit located within the retaining ring make an angle normal with the surface of the retaining ring positionable adjacent the polishing pad; and a pump configured to deliver the flow of slurry under pressure through the slurry conduit to a surface of the polishing pad.

15. The polishing system as recited in claim 14 wherein the polishing system includes a polishing head and the retaining ring forms a portion of the polishing head.

16. The polishing system as recited in claim 14 wherein the polishing system further includes a polishing platen on which the polishing pad is mounted.

17. The polishing system as recited in claim 16 wherein the polishing system further includes a motor, coupled to the polishing platen, configured to rotate the polishing platen during a polishing operation.

18. The polishing system as recited in claim 14 wherein the polishing system further includes a motor, coupled to the carrier head assembly, configured to rotate the carrier head assembly during a polishing operation.

19. The polishing head as recited in claim 14 wherein the carrier head assembly includes a carrier head slurry conduit that provides a flow of pressurized slurry to the slurry conduit in the retaining ring.

20. The polishing system as recited in claim 19 further including a slurry delivery system having a supply tank and a delivery conduit, coupled to the supply tank, for delivering slurry to the carrier head slurry conduit.

* * * * *